US008121299B2

(12) United States Patent
Sakurai et al.

(10) Patent No.: US 8,121,299 B2
(45) Date of Patent: Feb. 21, 2012

(54) METHOD AND SYSTEM FOR MUSIC DETECTION

(75) Inventors: Atsuhiro Sakurai, Ibaraki (JP); Steven David Trautmann, Ibaraki (JP)

(73) Assignee: Texas Instruments Incorporated, Dallas, TX (US)

( * ) Notice: Subject to any disclaimer, the term of this patent is extended or adjusted under 35 U.S.C. 154(b) by 870 days.

(21) Appl. No.: 12/185,787

(22) Filed: Aug. 4, 2008

(65) Prior Publication Data

US 2009/0060211 A1 Mar. 5, 2009

Related U.S. Application Data

(60) Provisional application No. 60/969,042, filed on Aug. 30, 2007.

(51) Int. Cl.
*H04R 29/00* (2006.01)

(52) U.S. Cl. ..... 381/56

(58) Field of Classification Search ..... None
See application file for complete search history.

(56) References Cited

U.S. PATENT DOCUMENTS

| | | | | |
|---|---|---|---|---|
| 6,570,991 | B1 * | 5/2003 | Scheirer et al. | 381/110 |
| 7,191,128 | B2 * | 3/2007 | Sall et al. | 704/233 |
| 7,386,217 | B2 * | 6/2008 | Zhang | 386/248 |
| 2006/0015327 | A1 * | 1/2006 | Gao | 704/207 |
| 2011/0029308 | A1 * | 2/2011 | Konchitsky et al. | 704/233 |
| 2011/0091043 | A1 * | 4/2011 | Wang | 381/17 |

OTHER PUBLICATIONS

Saunders, J., "Real-time discrimination of broadcast speech/music," Proc. of ICASSP'96, 1996, pp. 993-996.

Scheirer, E. and Slaney, M., "Construction and evaluation of a robust multifeature speech/music discriminator," Proc. ICASSP'97, 1997, pp. 1331-1334.

Carey, M.J., et al., "A comparison of features for speech, music discrimination," Proc. ICASSP'99, 1999, pp. 149-152.

Tolonen, Tero, and Karjalainen, Matti, "A Computationally Efficient Multipitch Analysis Model," IEEE Transactions on Speech and Audio Processing, vol. 8, No. 6, Nov. 2000, pp. 708-716.

* cited by examiner

*Primary Examiner* — Benjamin Sandvik

(74) *Attorney, Agent, or Firm* — Mirna Abyad; Wade J. Brady, III; Frederick J. Telecky, Jr.

(57) ABSTRACT

Methods, digital systems, and computer readable media are provided for detection of music in an audio signal. Music is detected by partitioning the audio signal into overlapping frames, determining a fundamental frequency of a frame in the overlapping frames, including the fundamental frequency of the frame in a histogram of fundamental frequency values of frames occurring in the audio signal prior to the frame, and indicating that music is present in the audio signal when a number of occurrences of a fundamental frequency value in the histogram exceeds a threshold.

17 Claims, 4 Drawing Sheets

METHOD AND SYSTEM FOR MUSIC DETECTION

CROSS-REFERENCE TO RELATED APPLICATIONS

This application claims priority from provisional application No. 60/969,042, filed Aug. 30, 2007. The following co-assigned, co-pending patent application discloses related subject matter: U.S. patent application Ser. No. 12/185,800, entitled Method and System for Determining Predominant Fundamental Frequency (TI-63672), filed Aug. 4, 2008.

BACKGROUND

Detecting the presence of music in an audio stream is a desirable feature in several applications. Examples include automatic switching on or off of sound effects (equalizer, virtual surround, bass boost, bandwidth extension, etc.) in audio players, automatic sorting of databases, etc. Many approaches to automatically discriminating speech from music have been developed but these approaches have limited success. In general, high computational cost and low robustness have prevented the use of such systems in real-world applications.

Many existing approaches for speech-music discrimination include the use of the zero-crossing rate as a discriminating feature. The zero-crossing rate provides a good measure of spectral distribution in the time domain and represents a useful feature to capture peculiarities of speech signals such as the succession of voiced and unvoiced speech. One approach, described in Saunders, J., "Real-time discrimination of broadcast speech/music," Proc. of ICASSP'96, pp. 993-996, uses the average zero-crossing rate as the main discriminating feature. However, the zero-crossing rate is not very effective in audio streams that include speech mixed with background music or high levels of noise. Thus other approaches use the zero-crossing rate in conjunction with other features to perform speech-music discrimination. Examples of such approaches are found in Scheirer, E. and Slaney, M., "Construction and evaluation of a robust multi-feature speech/music discriminator," Proc. ICASSP 1997, pp. 1331-1334 and Carey, M. J., Parris, E. S., and Lloyd-Thomas, H., "A comparison of features for speech, music discrimination," Proc. ICASSP 1999, pp. 149-152. These complex approaches tend to be computationally expensive and thus impractical for many applications.

SUMMARY

Embodiments of the invention provide methods and system for music detection, i.e., the detection of the presence of music signals, in an audio stream based on repetitive patterns that appear in the fundamental frequency (F0) contours of the audio stream. Repetitive patterns are detected using a short-term histogram of the latest F0 values that is updated on a frame-by-frame basis. F0 histograms derived from music signals tend to show peaks due to the presence of flat and/or repetitive melodic structures. These peaks are used to identify the presence of music.

BRIEF DESCRIPTION OF THE DRAWINGS

Particular embodiments in accordance with the invention will now be described, by way of example only, and with reference to the accompanying drawings.

DETAILED DESCRIPTION

Figure 1:
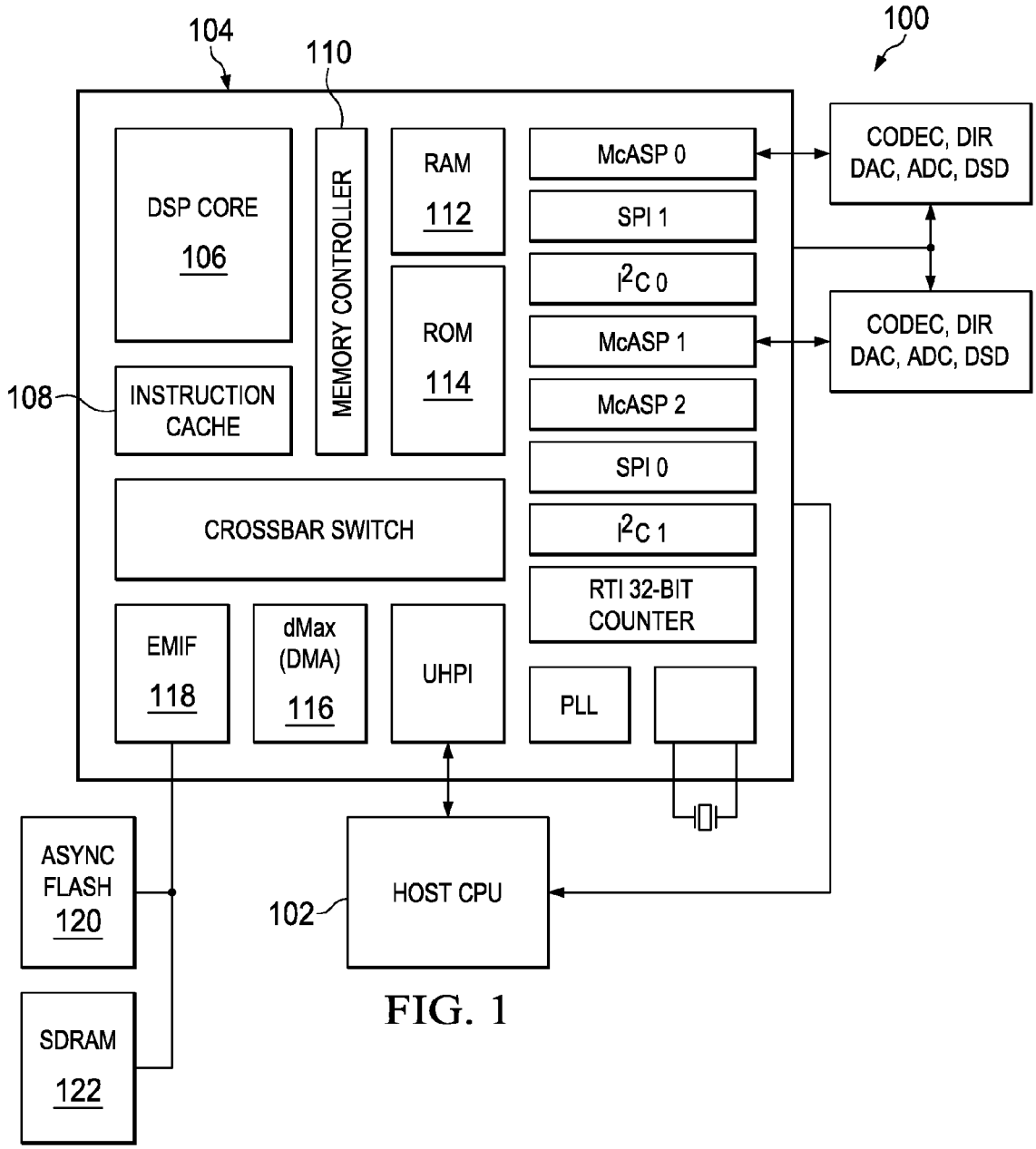
FIG. 1 shows a block diagram of an illustrative digital system in accordance with one or more embodiments of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description. In addition, although method steps may be presented and described herein in a sequential fashion, one or more of the steps shown and described may be omitted, repeated, performed concurrently, and/or performed in a different order than the order shown in the figures and/or described herein. Accordingly, embodiments of the invention should not be considered limited to the specific ordering of steps shown in the figures and/or described herein.

In general, embodiments of the invention provide methods and systems for detection of music in audio streams. More specifically, embodiments of the invention provide for detecting the presence of music signals in an audio stream based on repetitive patterns in the F0 contour of the audio stream. As is explained in more detail below, in one or more embodiments of the invention, a short-term history of F0 values is tracked as a histogram that is updated on a frame-by-frame basis. Music signals tend to show F0 values that consistently assume certain values, either in the form of flat F0 contours or relatively scattered (but statistically skewed) patterns. A signal may be classified as music if a maximum value of the short-term F0 histogram exceeds a predetermined threshold.

The methods and systems for detection of music described herein require only a small number of computations, with most of the computation required for F0 detection. The computational cost to manage the short-term histogram is negligible. Further, the music detection is robust against incorrect F0 contour detection, i.e., even if an incorrect F0 value is selected, the music detection will operate correctly as long as any music present in the audio signal shows more repetitive values than speech present in the audio signal. Further, the robustness is further enhanced by the fact that this approach to music detection does not require F0 contours to follow specific patterns. In addition, embodiments of the invention may be used in isolation for music detection or in conjunction with other features in more complex systems.

Embodiments of methods for music detection described herein may be performed on many different types of digital systems that incorporate audio processing, including, but not limited to, portable audio players, cellular telephones, AV, CD and DVD receivers, HDTVs, media appliances, set-top boxes, multimedia speakers, video cameras, digital cameras, and automotive multimedia systems. Such digital systems may include any of several types of hardware: digital signal processors (DSPs), general purpose programmable processors, application specific circuits, or systems on a chip (SoC) which may have multiple processors such as combinations of DSPs, RISC processors, plus various specialized programmable accelerators.

FIG. 1 is an example of one such digital system (100) that may incorporate the methods for music detection as described below. Specifically, FIG. 1 is a block diagram of an example digital system (100) configured for receiving and transmitting audio signals. As shown in FIG. 1, the digital system (100) includes a host central processing unit (CPU) (102) connected to a digital signal processor (DSP) (104) by a high speed bus. The DSP (104) is configured for multi-channel audio decoding and post-processing as well as high-speed audio encoding. More specifically, the DSP (104) includes, among other components, a DSP core (106), an instruction cache (108), a DMA engine (dMAX) (116) optimized for audio, a memory controller (110) interfacing to an onchip RAM (112) and ROM (114), and an external memory interface (EMIF) (118) for accessing offchip memory such as Flash memory (120) and SDRAM (122). In one or more embodiments of the invention, the DSP core (106) is a 32-/64-bit floating point DSP core. In one or more embodiments of the invention, the methods described herein may be partially or completely implemented in computer instructions stored in any of the onchip or offchip memories. The DSP (104) also includes multiple multichannel audio serial ports (McASP) for interfacing to codecs, digital to audio converters (DAC), audio to digital converters (ADC), etc., multiple serial peripheral interface (SPI) ports, and multiple inter-integrated circuit ($I^2C$) ports. In one or more embodiments of the invention, the methods for detecting music described herein may be performed by the DSP (104) on frames of an audio stream after the frames are decoded.

Figure 2:
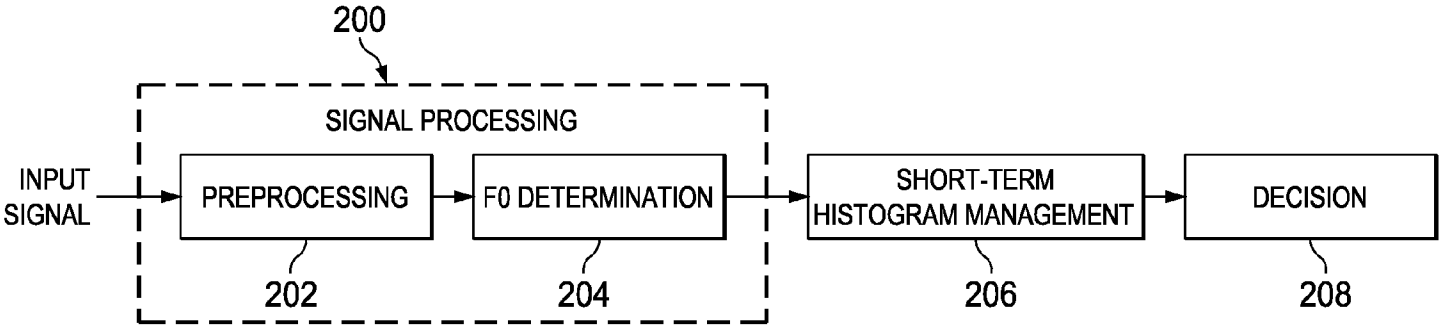
FIG. 2 shows a flow diagram of a method for music detection in accordance with one or more embodiments of the invention.

FIG. 2 shows a flow diagram of a method for music detection in accordance with one or more embodiments of the invention. As shown in FIG. 2, the method includes a signal processing phase (200) that includes pre-processing (202) and fundamental frequency (F0) determination (204), a short-term histogram management phase (206), and a threshold-based decision making phase (208).

As shown in FIG. 2, the music detection begins with pre-processing (202) of a raw input audio signal. In one or more embodiments of the invention, pre-processing includes down-mixing multi-channel or stereo signals into a single monaural mixture, down-sampling the single monaural mixture to a lower sampling frequency (e.g., 12 kHz), and then dividing the resulting signal into overlapping frames. In some embodiments of the invention, the duration of each overlapping frame is around 42 ms (e.g., about 500 samples at a 12 kHz sampling rate) and the shift time is 21 ms (i.e., 50% overlap). Down-mixing and down-sampling are performed to simplify subsequent processing for higher efficiency.

In the second part of the signal processing phase (200), the fundamental frequency (F0) of each frame is determined. In one or more embodiments of the invention, F0 determination is performed using a method described in the cross-referenced application Ser. No. 12/185,800 (TI-63672), which is incorporated herein by reference. However, any pitch tracking scheme (i.e., F0 determination scheme) that can handle F0 determination for combined speech and music signals may be used. For example, the approach described in Tolonen, Tero, and Karjalainen, Matti, "A Computationally Efficient Multipitch Analysis Model," IEEE Transactions on Speech and Audio Processing, Vol. 8, No. 6, November 2000 may be used in some embodiments of the invention.

The cross-referenced application describes a dynamic envelope autocorrelation function for determining F0 for the n-th frame of an audio signal as:

$$R_n(k)=\Sigma_{0\leq j\leq L-1}\{(|x_n[j+k]|>>m)\mathrm{sign}(x_n[j+k])\}\{(|x_n[j]|>>m)\mathrm{sign}(x_n[j])\}$$

where the signal amplitude is downshifted by m bits where m is determined by the maximum absolute signal amplitude in history data. In one or more embodiments of the invention, the history data is in a range of about 100-200 prior frames. The fundamental frequency is found from the peaks (fundamental period) of $R_n(k)$.

Each successive frame (e.g., every 21 ms) provides another F0 value, which replaces the oldest F0 value in a data structure in storage. The data structure may be any suitable data structure. In some embodiments of the invention, the data structure may represent a FIFO queue maintaining a fixed number of previously detected F0 values. The fixed number of prior F0 values may be 100-200 (e.g., about 2-4 seconds of audio input). Further, in some embodiments of the invention, the fixed number of values is 187.

After each F0 value is determined and stored, short-term histogram management is performed (206). That is, a histogram of the F0 values for a predetermined number n of frames is maintained. In one or more embodiments of the invention, the histogram is updated on a frame-by-frame basis. Each new F0 value is quantized and fed into the histogram and the oldest F0 value is discarded. Thus, the short-term histogram includes only the F0 values for the current frame and the previous n-1 frames. Further, in some embodiments of the invention, the histogram is updated periodically, rather than on a frame-by-frame basis. For example, this histogram may be updated after each m F0 values are determined, where m is an empirically determined value.

In one or more embodiments of the invention, 174 F0 values from 60 Hz to 480 Hz are considered, that is, a resolution of approximately 2.4 Hz. The resolution must not be too fine because the music detection method would tend to classify F0 values in different parts of the histogram even when they are close. However, the resolution cannot be too coarse either because non-music signals would be assigned flat F0 values, leading to an incorrect classification as music.

Histograms are more effective than merely tracking flat portions of the F0 contour or comparing the F0 contour with stylized patterns (pattern recognition). Histograms capture cases where F0 values tend to assume certain values without necessarily forming continuous F0 contours, which is often the case of music with a fast tempo. Also, no specific shapes are assumed, thus the need for unrealistically large numbers of patterns with proportionally large training databases is avoided.

Figure 3A:
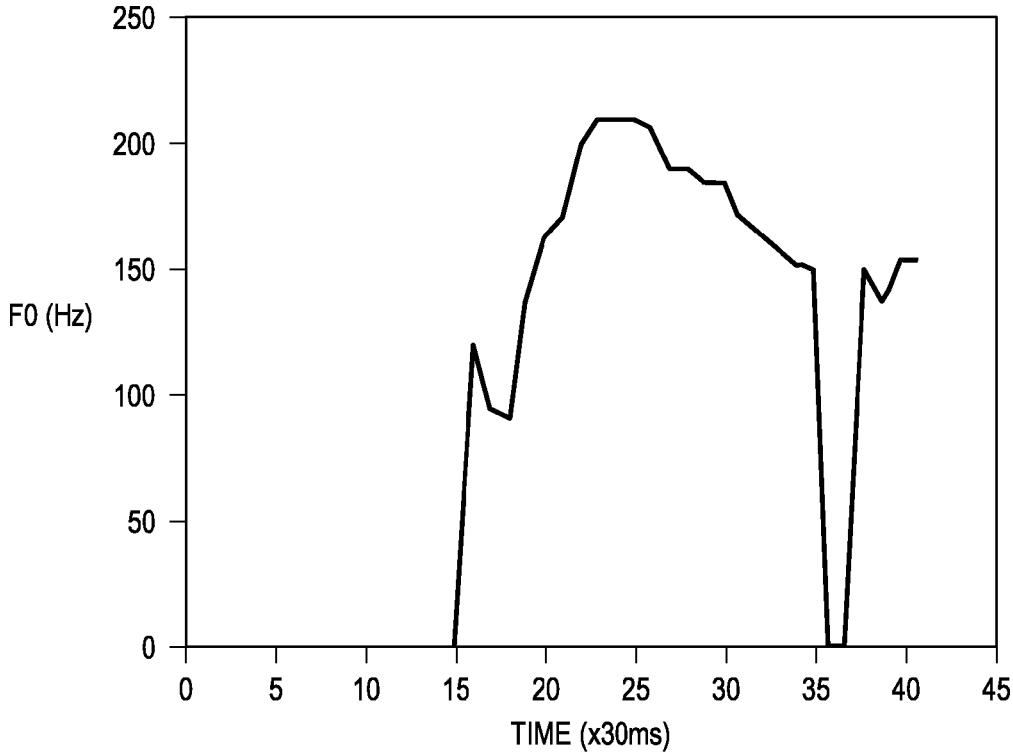
FIGS. 3A and 3B show, respectively, an example speech fundamental frequency contour and a corresponding histogram.
Figure 3B:
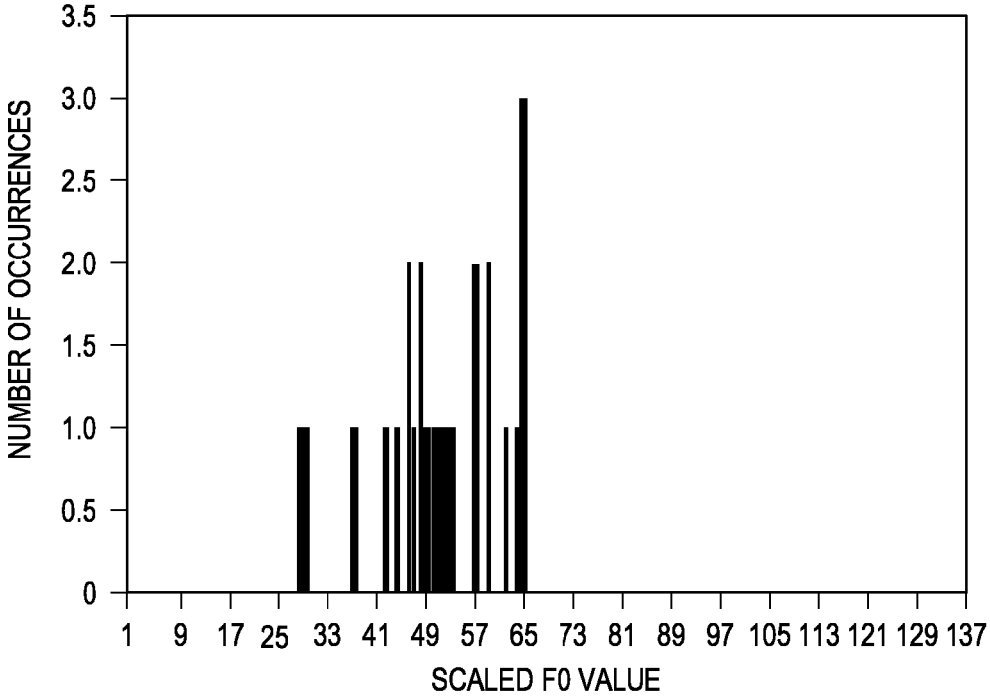
Figure 4A:
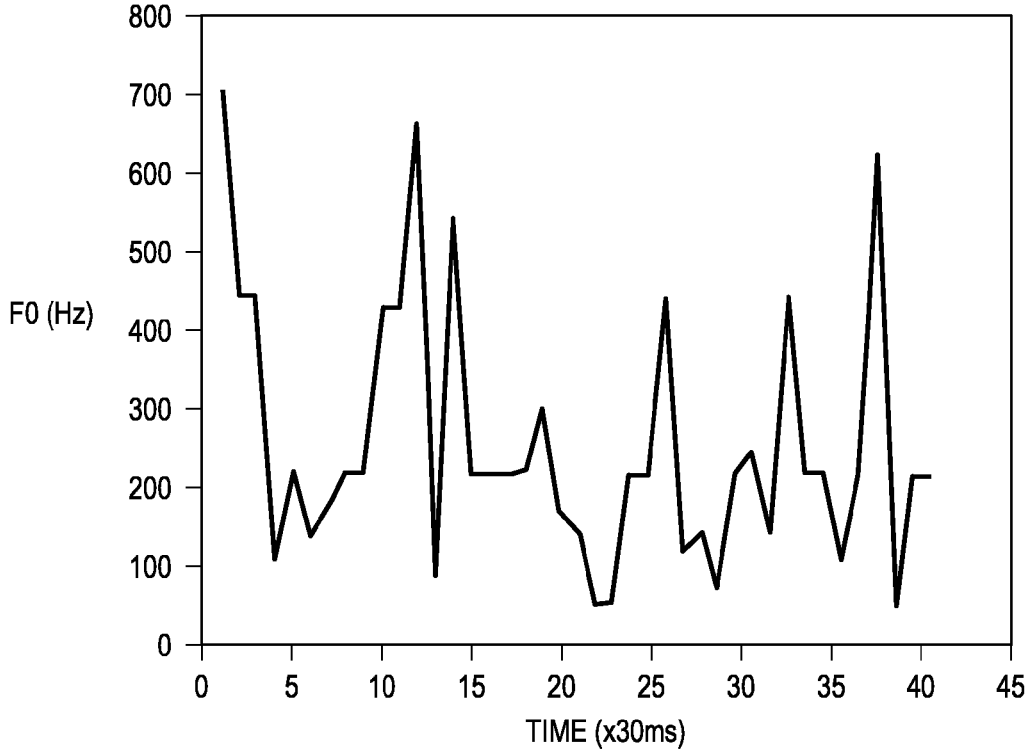
FIGS. 4A and 4B show, respectively, an example music fundamental frequency contour and a corresponding histogram.
Figure 4B:
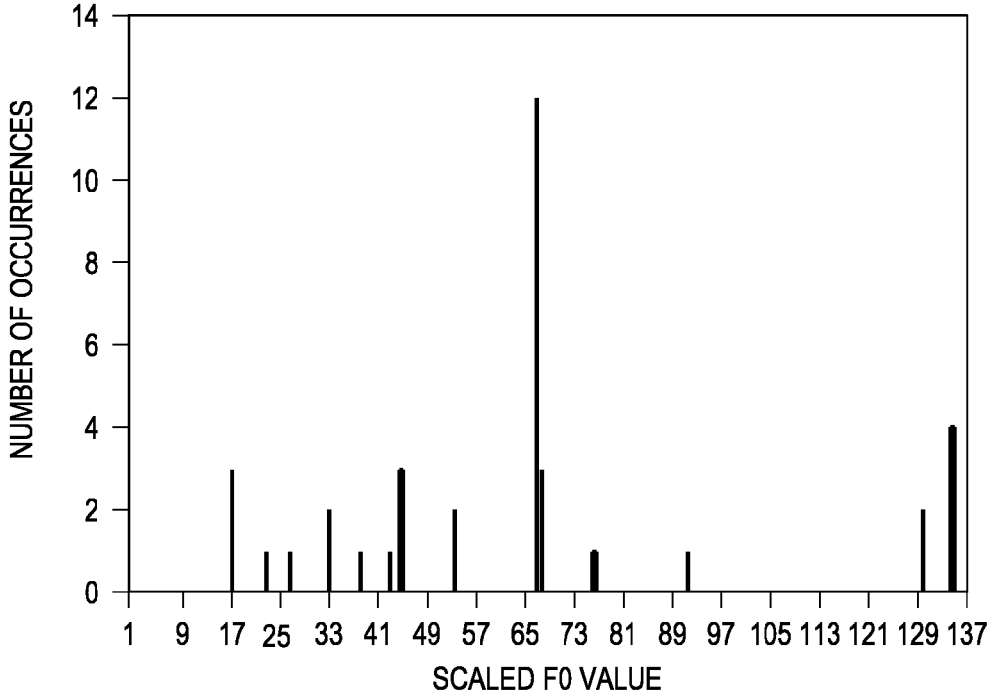

FIG. 3A shows an example of a sequence of F0 values (i.e., an F0 contour) for a speech segment, and FIG. 3B shows the corresponding histogram of quantized F0 values. Likewise, FIG. 4A shows an example of a music F0 contour, and FIG. 4B the corresponding histogram. In FIGS. 3B and 4B, the scaling formula for F0 is $$\text{Scaled } F0=F0/(\text{Max. } F0)*(\text{Size of Histogram})$$

where Max. F0=800 Hz and Size of Histogram=256.

The histogram produced by the short-term histogram management (206) is then used to decide if music is present in the input audio signal. (208). In one or more embodiments of the invention, music signals are assumed to show repetitive F0 contours that often include straight horizontal lines. Straight lines appear in monophonic music with relatively slow tempo while polyphonic music with relatively fast tempo yields discontinuous F0 values that nonetheless tend to cluster in a limited number of values. In both cases, these F0 value tendencies can be efficiently captured in the short-term histogram. Referring again to FIGS. 3A, 3B, 4A, and 4B, these figures contrast speech with music F0 contours, as well as their respective short-term histograms. Note that the histogram of the music signal in FIG. 4B reflects the repetitive structure of the corresponding F0 contour in FIG. 4A and its peak is considerably higher than that observed in the histogram of the speech signal in FIG. 3B extracted from the speech F0 contour shown in FIG. 3A. FIG. 4B may be identified as pertaining to a music signal by noting the high peak found in its short-term F0 histogram.

In one or more embodiments of the invention, the decision (208) regarding the presence of music, i.e., music detection, is based on comparison to a threshold. That is, if the maximum value of the short-term F0 histogram exceeds an empirically determined threshold, the frame is classified as music. In some embodiments of the invention, an indicator is set to indicate that music has been detected. For example, a flag in the form of a global variable or a bit in a status register may change value in real-time as an audio signal is played, indicating speech or music on a frame-by-frame basis. In some embodiments of the invention, the empirically determined threshold value is 5 occurrences of an F0 value for a histogram of 100-200 F0 values. The value 5 was determined experimentally by executing an implementation of the method on a database containing speech and music samples. In this experiment, the maximum number of repetitions in the histogram exceeded 5 most of the time when music signal were played, and did not exceed 5 when speech signals were played. The value depends directly on the length of the history, i.e., the number of entries in the FIFO queue (which is 50, or approximately 1.5 second, in some embodiments of the invention). The size of the histogram and its resolution may also affect that threshold too, but to a lesser extent.

In some embodiments of the invention, the decision (208) also includes a measure of the slope of the F0 contour. The pitch (i.e., F0 contour) in short voiced speech segments typically declines, as is apparent in FIG. 3A for frames 25 to 35. Thus, the measure of the slope can be used to vary the threshold used for deciding if music is present. For example, a lower threshold of 5 F0 occurrences in the histogram may be used when the F0 contour slope does not decline, and a higher threshold of 10 F0 occurrences may be used when a contour decline is detected.

Figure 5:
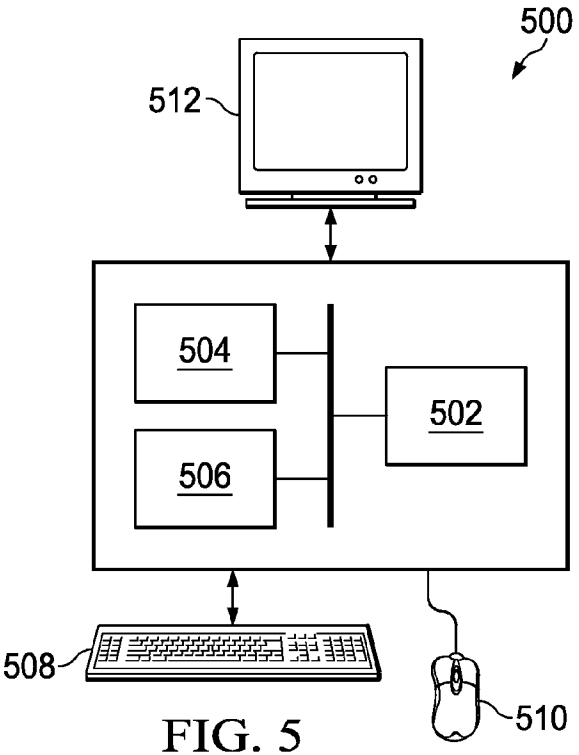
FIG. 5 shows an illustrative digital system in accordance with one or more embodiments of the invention.

As previously mentioned, embodiments of the music detection methods and systems described herein may be implemented on virtually any type of digital system. Further examples include, but are not limited to a desk top computer, a laptop computer, a handheld device such as a mobile (i.e., cellular) phone, a personal digital assistant, a digital camera, an MP3 player, an iPod, etc). Further, embodiments may include a digital signal processor (DSP), a general purpose programmable processor, an application specific circuit, or a system on a chip (SoC) such as combinations of a DSP and a RISC processor together with various specialized programmable accelerators. For example, as shown in FIG. 5, a digital system (500) includes a processor (502), associated memory (504), a storage device (506), and numerous other elements and functionalities typical of today's digital systems (not shown). In one or more embodiments of the invention, a digital system may include multiple processors and/or one or more of the processors may be digital signal processors. The digital system (500) may also include input means, such as a keyboard (508) and a mouse (510) (or other cursor control device), and output means, such as a monitor (512) (or other display device). The digital system ((500)) may also include an image capture device (not shown) that includes circuitry (e.g., optics, a sensor, readout electronics) for capturing digital images. The digital system (500) may be connected to a network (514) (e.g., a local area network (LAN), a wide area network (WAN) such as the Internet, a cellular network, any other similar type of network and/or any combination thereof) via a network interface connection (not shown). Those skilled in the art will appreciate that these input and output means may take other forms.

Further, those skilled in the art will appreciate that one or more elements of the aforementioned digital system (500) may be located at a remote location and connected to the other elements over a network. Further, embodiments of the invention may be implemented on a distributed system having a plurality of nodes, where each portion of the system and software instructions may be located on a different node within the distributed system. In one embodiment of the invention, the node may be a digital system. Alternatively, the node may be a processor with associated physical memory. The node may alternatively be a processor with shared memory and/or resources.

Software instructions to perform embodiments of the invention may be stored on a computer readable medium such as a compact disc (CD), a diskette, a tape, a file, or any other computer readable storage device. The software instructions may be a standalone program, or may be part of a larger program (e.g., a photo editing program, a web-page, an applet, a background service, a plug-in, a batch-processing command). The software instructions may be distributed to the digital system (500) via removable memory (e.g., floppy disk, optical disk, flash memory, USB key), via a transmission path (e.g., applet code, a browser plug-in, a downloadable standalone program, a dynamically-linked processing library, a statically-linked library, a shared library, compilable source code), etc. The digital system (500) may access a digital image by reading it into memory from a storage device, receiving it via a transmission path (e.g., a LAN, the Internet), etc.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims. It is therefore contemplated that the appended claims will cover any such modifications of the embodiments as fall within the true scope and spirit of the invention.

What is claimed is:

1. A method of detecting music in an audio signal, the method comprising:

partitioning the audio signal into overlapping frames;

determining a fundamental frequency of a frame in the overlapping frames;

including the fundamental frequency of the frame in a histogram of fundamental frequency values of frames occurring in the audio signal prior to the frame; and indicating that music is present in the audio signal when a number of occurrences of a fundamental frequency value in the histogram exceeds a threshold, wherein a value of the threshold is based on a slope of an F0 contour of the audio signal.

2. The method of claim 1, wherein the histogram includes 100-200 fundamental frequency values.

3. The method of claim 1, wherein the threshold is 5.

4. The method of claim 1, wherein the threshold is 10 when a slope of an F0 contour of the audio signal is declining.

5. The method of claim 1, wherein the threshold is 5 when a slope of an F0 contour of the audio signal is not declining.

6. The method of claim 1, wherein determining the fundamental frequency further comprises using dynamic envelope autocorrelation.

7. The method of claim 1, wherein the method is executed on a digital signal processor configured for multi-channel audio decoding and post-processing.

8. A digital system for detecting music in an audio signal, the digital system comprising:

a digital signal processor; and a memory storing software instructions, wherein when executed by the digital signal processor, the software instructions cause the digital system to perform a method comprising:

partitioning the audio signal into overlapping frames;

determining a fundamental frequency of a frame in the overlapping frames;

including the fundamental frequency of the frame in a histogram of fundamental frequency values of frames occurring in the audio signal prior to the frame; and indicating that music is present in the audio signal when a number of occurrences of a fundamental frequency value in the histogram exceeds a threshold, wherein a value of the threshold is based on a slope of an F0 contour of the audio signal.

9. The digital system of claim 8, wherein the histogram includes 100-200 fundamental frequency values.

10. The digital system of claim 8, wherein the threshold is 5.

11. The digital system of claim 8, wherein the threshold is 10 when a slope of an F0 contour of the audio signal is declining.

12. The digital system of claim 8, wherein the threshold is 5 when a slope of an F0 contour of the audio signal is not declining.

13. The digital system of claim 8, wherein determining the fundamental frequency further comprises using dynamic envelope autocorrelation.

14. A computer readable medium comprising executable instructions to detect music in an audio signal by:

partitioning the audio signal into overlapping frames;

determining a fundamental frequency of a frame in the overlapping frames;

including the fundamental frequency of the frame in a histogram of fundamental frequency values of frames occurring in the audio signal prior to the frame; and indicating that music is present in the audio signal when a number of occurrences of a fundamental frequency value in the histogram exceeds a threshold, wherein a value of the threshold is based on a slope of an F0 contour of the audio signal.

15. The computer readable medium of claim 14, wherein the histogram includes 100-200 fundamental frequency values.

16. The computer readable medium of claim 14, wherein the threshold is 5.

17. The computer readable medium of claim 14, wherein the threshold is 10 when a slope of an F0 contour of the audio signal is declining and the threshold is 5 when the slope of the F0 contour of the audio signal is not declining.

* * * * *